United States Patent [19]

Dallum

[11] Patent Number: 4,876,124

[45] Date of Patent: Oct. 24, 1989

[54] UNDERGROUND TANK

[75] Inventor: Barry J. Dallum, Montgomery, Tex.

[73] Assignee: Owens-Corning Fiberglas Corporation, Toledo, Ohio

[21] Appl. No.: 208,333

[22] Filed: Jun. 16, 1988

Related U.S. Application Data

[63] Continuation of Ser. No. 914,977, Oct. 3, 1986, abandoned.

[51] Int. Cl.[4] ..... B65D 90/02; B65G 5/00

[52] U.S. Cl. ..... 428/34.5; 220/1 B; 405/53; 428/36.4; 428/251; 428/285; 428/286; 428/431; 428/432; 428/441; 428/442

[58] Field of Search ..... 405/53; 220/1 B; 428/34.5, 442, 251, 441, 285, 286, 431, 432, 36.4

[56] References Cited

U.S. PATENT DOCUMENTS

| | | | |
|---|---|---|---|
| 4,138,516 | 2/1979 | Marrs et al. | 428/35.8 |
| 4,143,790 | 3/1979 | Ueno et al. | 428/35.8 |
| 4,234,633 | 11/1980 | Gowetski et al. | 428/34.5 |
| 4,555,536 | 11/1985 | Maki et al. | 525/452 |

FOREIGN PATENT DOCUMENTS

| | | |
|---|---|---|
| 1091901 | 12/1980 | Canada . |
| 0156245 | 9/1982 | Japan . |

*Primary Examiner*—Ellis P. Robinson
*Assistant Examiner*—James J. Seidleck
*Attorney, Agent, or Firm*—Patrick P. Pacella

[57] ABSTRACT

A tank having a composite wall including an inner wall and an outer wall, the inner wall comprising a material resistant to corrosion by gasoline or alcohol and the outer wall comprising a non-hydrolyzable resin.

11 Claims, 1 Drawing Sheet

UNDERGROUND TANK

This is a continuation of application Ser. No. 914,977, filed 10/3/86 now abandoned.

TECHNICAL FIELD

This invention relates generally to underground storage tanks, and more particularly to tanks for storing liquids such as gasoline.

BACKGROUND ART

Prior glass fiber reinforced synthetic resin underground tanks for storing gasoline were made of thermosetting resins such as isophthalic polyester, which resists corrosion by gasoline. However, such resins are subject to chemical decomposition by hydrolysis when water is present on the outside of the tank.

DISCLOSURE OF INVENTION

In accordance with the invention, a tank is provided having a liner comprising a thermoset resin resistant to corrosion by gasoline or alcohol, such as polyester or vinylester, and a structural wall comprising a thermoset or thermoplastic non-hydrolyzable resin such as cross-linked polystyrene, polyethylene, polypropylene, or rigid polyvinyl chloride.

BRIEF DESCRIPTION OF THE DRAWINGS

The invention will be more readily understood by reference to the accompanying drawings wherein.

BEST MODE OF CARRYING OUT THE INVENTION

Figure 1:
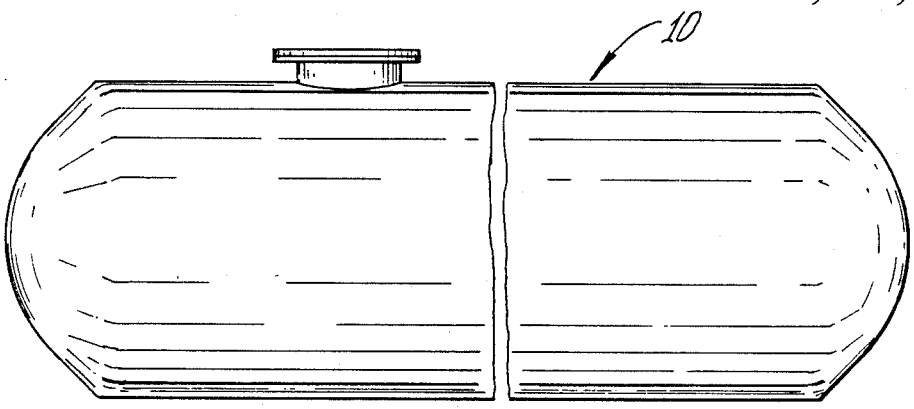
FIG. 1 is a view of an underground tank constructed in accordance with the invention.

With reference to the drawings, FIG. 1 shows a glass fiber reinforced plastic tank 10 constructed in accordance with the invention. Preferably the tank is provided with axially spaced annular reinforcing ribs (not shown) such as illustrated on the tank of U.S. Pat. No. 3,700,512. The tank is made in two halves secured together by internal and external lay-ups of resin and glass mat, such as shown in FIG. 16 of U.S. Pat. No. 3,655,468.

Figure 2:
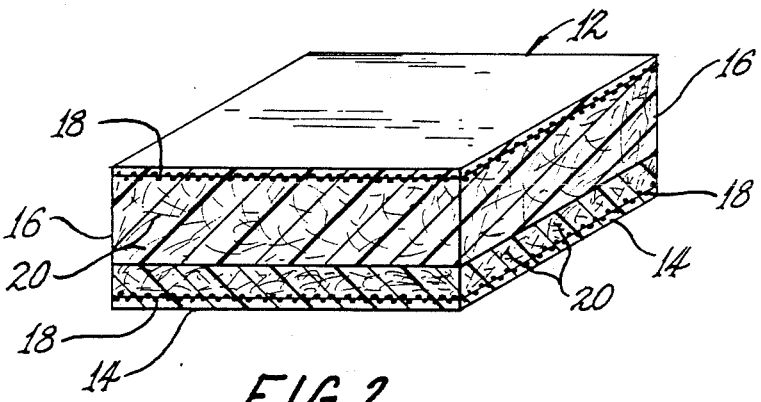
FIG. 2 is an enlarged fragmentary isometric sectional view illustrating the construction of the wall of the tank of FIG. 1.

As shown in FIG. 2, a composite wall section 12 of the tank 10 comprises a liner or inner wall 14 and a structural outer wall portion 16. In accordance with the invention, the liner 14 comprises a resin resistant to corrosion by gasoline or alcohol, such as an unsaturated polyester or a vinyl ester, and the structural wall 16 cmprises a non-hydrolyzable resin, such as rigid polyvinyl chloride, polyethylene, polypropylene, or cross-linked polystyrene with up to 50 percent of a cross-linking agent such as divinyl benzene, trivinyl benzene, or nitrogen dioxide. A thin non-woven glass fiber surfacing mat 18 is provided in the liner 14, and optionally also in the structural wall 16. Inside the surfacing mat 18 of the liner, and also of the structural wall if it is provided with one, the resins are reinforced with chopped glass strands 20 and may contain fillers such as sand, talc, limestone dust, flyash, clay, or milled glass fibers.

Each half of the tank 10 may be formed on a collapsible mandrel, such as disclosed in U.S. Pat. No. 4,233,020, preferably having an integral end cap mold as disclosed in U.S. Pat. No. 4,225,302.

Figure 3:
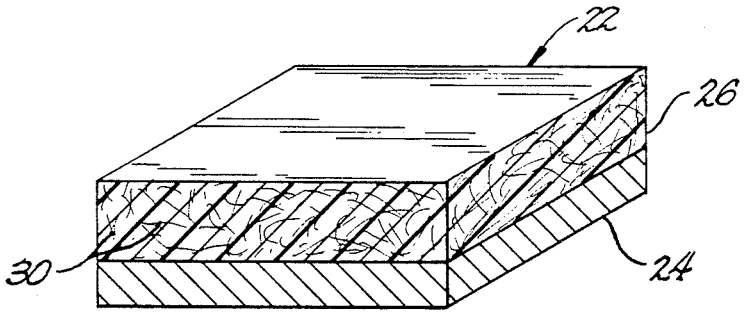
FIG. 3 is a view similar to FIG. 2, but showing an alternate construction.

FIG. 3 shows an alternate construction wherein a wall secton 22 of the tank 10 comprises a steel tank portion 24 having a coating or outer wall thickness of a non-hydrolyzable resin 26 containing chopped glass strand 30 and suitable filler.

Various modifications may be made in the structure shown and described without departing from the spirit and scope of the invention.

I claim:

1. A storage tank particularly adapted for use underground and having a composite wall consisting of a first layer of a non-hydrolyzable resin, a second layer of a first glass fiber mat, a third layer of a non-hydrolyzable resin reinforced with chopped glass strands, a fourth layer of a resin resistant to corrosion by gasoline or alcohol, and reinforced with chopped glass strands, a fifth layer of a second glass fiber mat, and a sixth layer of a resin resistant to corrosion by gasoline and alcohol.

2. A storage tank as claimed in claim 1 wherein the non-hydrolyzable resin of the first and third layers is a thermoset resin or a thermoplastic resin.

3. A storage tank as claimed in claim 1 wherein the non-hydrolyzable resin of the first and third layer is a thermoplastic resin.

4. A storage tank as claimed in claim 1 wherein the non-hydrolyzable resin of the first and third layer is polystyrene.

5. A storage tank as claimed in claim 1 wherein the non-hydrolyzable resin of the first and third layer is a cross-linked polystyrene with up to 50% of a cross-linking agent selected from the group comprising divinyl benzene, trivinyl benzene, or nitrogen dioxide.

6. A storage tank as claimed in 1 wherein the non-hydrolyzable resin of the first and third layer is polyethylene.

7. A storage tank as claimed in claim 1 wherein the non-hydrolyzable resin of the first and third layer is polypropylene.

8. A storage tank as claimed in claim 1 wherein the non-hydrolyzable resin of the first and third layer is rigid polyvinyl chloride.

9. The storage tank of claim 1, wherein the fourth layer consists of the resin resistant to corrosion by gasoline or alcohol which is reinforced with chopped strands and fillers selected from the group comprising sand, talc, linestone dust, fly ash, clay or milled glass fibers.

10. A storage tank as claimed in claim 1 wherein the corrosion resistant resin of the first and third layer comprises polyester resin.

11. A storage tank as claimed in claim 1 wherein the corrosion resistant resin of the first and third layer comprises vinylester resin.

* * * * *